US007048814B2

(12) United States Patent
Lin et al.

(10) Patent No.: US 7,048,814 B2
(45) Date of Patent: May 23, 2006

(54) HALOGEN-RESISTANT, ANODIZED ALUMINUM FOR USE IN SEMICONDUCTOR PROCESSING APPARATUS

(75) Inventors: Yixing Lin, Saratoga, CA (US); Brian T. West, San Jose, CA (US); Hong Wang, Cupertino, CA (US); Shun Jackson Wu, Cupertino, CA (US); Jennifer Y Sun, Sunnyvale, CA (US); Clifford C. Stow, Santa Clara, CA (US); Senh Thach, Union City, CA (US)

(73) Assignee: Applied Materials, Inc., Santa Clara, CA (US)

( * ) Notice: Subject to any disclaimer, the term of this patent is extended or adjusted under 35 U.S.C. 154(b) by 291 days.

(21) Appl. No.: 10/071,869

(22) Filed: Feb. 8, 2002

(65) Prior Publication Data

US 2003/0150530 A1 Aug. 14, 2003

(51) Int. Cl.
*C25D 3/04* (2006.01)

(52) U.S. Cl. ..... 148/518; 205/213; 205/328

(58) Field of Classification Search ..... 148/440, 148/518; 420/542; 205/324, 325, 213, 328
See application file for complete search history.

(56) References Cited

U.S. PATENT DOCUMENTS

| | | | | |
|---|---|---|---|---|
| 4,245,698 | A | 1/1981 | Berkowitz et al. | |
| 4,540,449 | A | 9/1985 | Yoshida et al. | 148/31.5 |
| 5,039,388 | A * | 8/1991 | Miyashita et al. | 204/192.32 |
| 5,120,626 | A * | 6/1992 | Fukuda et al. | 430/58.1 |
| 5,192,610 | A | 3/1993 | Lorimer et al. | 428/33.6 |
| 5,756,222 | A | 5/1998 | Bercaw et al. | |
| 5,811,195 | A | 9/1998 | Bercaw et al. | |
| 5,952,083 | A | 9/1999 | Parthasarathi | |
| 6,066,392 | A * | 5/2000 | Hisamoto et al. | 428/304.4 |
| 6,132,531 | A | 10/2000 | Fang et al. | |
| 6,242,111 | B1 | 6/2001 | Telford et al. | 428/629 |
| 6,565,984 | B1 * | 5/2003 | Wu et al. | 428/472.2 |
| 6,713,188 | B1 * | 3/2004 | Wu et al. | 428/472.2 |
| 2001/0019777 | A1 | 9/2001 | Tanaka et al. | |

FOREIGN PATENT DOCUMENTS

| | | |
|---|---|---|
| EP | 0792951 | 9/1997 |
| EP | 1138793 | 3/2001 |
| JP | 02051212 | 2/1990 |
| JP | 02122054 | 5/1990 |
| JP | 08311594 | 11/1996 |
| JP | 10088271 | 4/1998 |

(Continued)

OTHER PUBLICATIONS

XP-002244144, pp. 585-597.*

(Continued)

*Primary Examiner*—George Waszomierski
*Assistant Examiner*—Janelle Morillo
(74) *Attorney, Agent, or Firm*—Duckor Spradling Metzger & Wynne

(57) ABSTRACT

We have discovered that the formation of particulate inclusions at the surface of an aluminum alloy article, which inclusions interfere with a smooth transition from the alloy surface to an overlying aluminum oxide protective film can be controlled by maintaining the content of mobile impurities within a specific range and controlling the particulate size and distribution of the mobile impurities and compounds thereof; by heat-treating the aluminum alloy at a temperature less than about 330° C.; and by creating the aluminum oxide protective film by employing a particular electrolytic process. When these factors are taken into consideration, an improved aluminum oxide protective film is obtained.

4 Claims, 2 Drawing Sheets

FOREIGN PATENT DOCUMENTS

| | | |
|---|---|---|
| WO | WO 01/40531 | 6/2001 |
| WO | WO 00/47793 | 8/2001 |

OTHER PUBLICATIONS

"Aluminum and Aluminum Alloys", ASM International, 1993, pp. 455-457, 462-472.*

Copy of Search Report in corresponding PCT Application Ser. No. PCT/US03/13790, filed Apr. 30, 2003.

ASM Committee on Aluminum and Aluminum Alloys, "Heat Treatment of Aluminum Alloys", Metals Handbook, pp. 28-43, 9th Ed., vol. 2, (American Society for Metals: Metals Park, OH).

I. Lerner et al., "An Electrochemically Sealed $Al_2O_3$ Passivation Layer for Aluminum Alloys", *J. Electrochem. Soc.*, vol. 129, No. 9, pp. 1865-1868 (1982).

A. K. Mukhopadhyay et al., "The Influence of Constituent Particles on the Quality of Hard Anodic Coatings on Fully Heat Treated AA 7075 Extrusion Products", *Materials Science Forum* vols. 217-222, pp. 1617-1622 (1996).

J. Timm et al., "Influence of iron- and silicon-containing phases on the anodization behavior", Eff. Iron Silicon Alum. Its Alloys, Proce. Int. Workshop, pp. 219-232 (1990).

"Metals Handbook", Ninth Edition, American Society for Metals, pp. 585-597 (1982).

* cited by examiner

HALOGEN-RESISTANT, ANODIZED ALUMINUM FOR USE IN SEMICONDUCTOR PROCESSING APPARATUS

BACKGROUND OF THE INVENTION

1. Field of the Invention

In general, the present invention relates to a method of fabrication of semiconductor processing apparatus from an aluminum substrate. In particular, the invention relates to a structure which provides a particular interface between an aluminum surface and aluminum oxide overlying that surface. The invention also relates to a method of producing the interfacial structure.

2. Brief Description of the Background Art

Semiconductor processing involves a number of different chemical and physical processes whereby minute integrated circuits are created on a substrate. Layers of materials which make up the integrated circuit are created by chemical vapor deposition, physical vapor deposition and epitaxial growth, for example. Some of the layers of material are patterned using photoresist masks and wet and dry etching techniques. Patterns are created within layers by the implantation of dopants at particular locations. The substrate upon which the integrated circuit is created may be silicon, gallium arsenide, indium phosphide, glass, or any other appropriate material.

Many of the semiconductor processes used to produce integrated circuits employ halogen or halogen-containing gases or plasmas. Some processes use halogen-containing liquids. In addition, since the processes used to create the integrated circuits leave contaminant deposits on the surfaces of the processing apparatus, such deposits are commonly removed using plasma cleaning techniques which employ at least one halogen-containing gas. The cleaning procedure may include a wet wipe with deionized water, followed by a wipe with isopropyl alcohol.

Aluminum has been widely used as a construction material for semiconductor fabrication equipment, at times because of its conductive properties, and generally because of its ease in fabrication and its availability at a reasonable price. However, aluminum is susceptible to reaction with halogens such as chlorine, fluorine, and bromine, to produce, for example, $AlCl_3$; $Al_2Cl_6$; $AlF_3$; or $AlBr_3$. The aluminum-fluorine compounds can flake off the surfaces of process apparatus parts, causing an eroding away of the parts themselves, and serving as a source of particulate contamination of the process chamber (and parts produced in the chamber). Many of the compounds containing aluminum and chlorine and many of the compounds containing aluminum and bromine are volatile and produce gases under semiconductor processing conditions, which gases leave the aluminum substrate. This creates voids in the structure which render the structure unstable and produce a surface having questionable integrity.

A preferred means of protecting the aluminum surfaces within process apparatus has been an anodized alumina coating. Anodizing is typically an electrolytic oxidation process that produces an integral coating of relatively porous aluminum oxide on the aluminum surface. Despite the use of anodized alumina protective layers, the lifetime of anodized aluminum parts in semiconductor processing apparatus, such as susceptors in CVD reactor chambers, and gas distribution plates for etch process chambers has been limited, due to the gradual degradation of the protective anodized film. Failure of the protective anodized film leads to excessive particulate generation within the reactor chamber, requiring maintenance downtime for replacing the failed aluminum parts and for cleaning particulates from the rest of the chamber.

Miyashita et al., in U.S. Pat. No. 5,039,388, issued Aug. 13, 1991, describe a plasma forming electrode used in pairs in a semiconductor processing chamber. The electrode is formed from a high purity aluminum or an aluminum alloy having a chromic acid anodic film on the electrode surface. The chromic acid anodized surface is said to greatly improve durability when used in a plasma treatment process in the presence of fluorine-containing gas. The electrode is described as formed from a high purity aluminum such as JIS 1050, 1100, 3003, 5052, 5053, and 6061 or similar alloys such as Ag—Mg alloys containing 2 to 6% by weight magnesium.

U.S. Pat. No. 5,756,222 to Bercaw et al., issued May 26, 1998, and titled: "Corrosion-Resistant Aluminum Article For Semiconductor Processing Equipment", describes an article of manufacture useful in semiconductor processing which includes a body formed from a high purity aluminum-magnesium alloy having a magnesium content of about 0.1% to about 1.5% by weight, either throughout the entire article or at least in the surface region which is to be rendered corrosion-resistant, and a mobile impurity atom content of less than 0.2% by weight. Mobile impurity atoms are said to consist of metal atoms other than magnesium, transitional metals, semiconductors, and atoms which form semiconductor compounds. Mobile impurity atoms particularly named include silicon, iron, copper, chromium and zinc. The high purity aluminum-magnesium alloy may be overlaid by a cohesive film which is permeable to fluorine, but substantially impermeable to oxygen. Examples of such a film include aluminum oxide or aluminum nitride. The subject matter disclosed in this patent is hereby incorporated by reference in its entirety.

U.S. Pat. No. 5,811,195 to Bercaw et al., issued Sep. 22, 1998, and titled: "Corrosion-Resistant Aluminum Article For Semiconductor Equipment", further discloses that the magnesium content of the aluminum article may be in the range of about 0.1% to about 6.0% by weight of the aluminum article. However, for operational temperatures of the article which are greater than about 250° C., the magnesium content of the aluminum article should range between about 0.1% by weight and about 1.5% by weight of the article. In addition, an article is described in which the mobile impurities other than magnesium may be as high as about 2.0% by weight in particular instances. One example is when there is a film overlying the exterior region of the article body, where the film comprises aluminum oxide or aluminum. Another example is where there is a magnesium halide layer having a thickness of at least about 0.0025 microns over the exterior surface of the aluminum article. The subject matter disclosed in this patent is hereby incorporated by reference in its entirety.

For an aluminum alloy to be useful in the fabrication of semiconductor processing apparatus, it must not only exhibit the desired magnesium content and low level of mobile impurity atoms, but it must also have desirable mechanical properties. The mechanical properties must enable machining to provide an article having the desired dimensions. For example, if the alloy is too soft, it is difficult to drill a hole, as material tends to stick during the drilling rather than to be removed by the drill. Controlling the dimensions of the machined article is more difficult. There is a penalty in machining cost. In addition, the mechanical properties of the article affect the ability of the article to perform under vacuum. For example, a process chamber must exhibit sufficient structural rigidity and resistance to deformation that it can be properly sealed against high vacuum. Finally, the mobile impurities need to be uniformly distributed throughout the article so that there is a uniform transfer of loads and stresses.

The "Metals Handbook, Ninth Edition", Volume 2, copyright 1979 by the American Society for Metals, describes the heat treatment of aluminum alloys beginning at Page 28. In particular, for both heat treatable and non-heat-treatable aluminum alloys, annealing to remove the effects of cold work is accomplished by heating within a temperature range from about 300° C. (for batch treatment) to about 450° C. (for continuous treatment). The term "heat treatment" applied to aluminum alloys is said to be frequently restricted to the specific operations employed to increase strength and hardness of the precipitation-hardenable wrought and cast alloys. These are referred to as "heat-treatable" alloys, to distinguish them from alloys in which no significant strengthening can be achieved by heating and cooling. The latter are generally said to be referred to as "non-heat-treatable" alloys, which, in wrought form, depend primarily on cold work to increase strength. At Page 29, Table 1 provides typical full annealing treatments for some common wrought aluminum alloys. The 5xxx series of alloys are considered to be "non-heat-treatable" aluminum alloys and are annealed at about 345° C. The 5xxx series of aluminum alloys are of interest for use in fabricating semiconductor processing apparatus because some of the alloys offer mobile impurity concentrations within acceptably moderate ranges, while providing sufficient magnesium content to perform in the manner described in the Bercaw et al. patents.

Standard thermal stress relief of "non-heat-treatable" aluminum alloys such as the 5xxx series assumes peak temperatures approaching 345° C. and generic ramp rates and dwell times, without regard to the alloy or the final use of individual articles fabricated from the alloy. Aluminum alloys begin to exhibit grain growth at temperatures approaching 345° C., and enhanced precipitation of non-aluminum metals at the grain boundaries, which may lead to cracking along the grain boundaries during machining. The above factors also reduce the mechanical properties of the alloy, by affecting the uniformity of the alloy composition within the article.

When the article fabricated from an aluminum alloy is to be used in a corrosive atmosphere, it frequently necessary to provide a protective coating such as anodized aluminum over the aluminum surface. This is particularly true for applications of aluminum in semiconductor processing where corrosive chlorine or fluorine-containing etchant gases and plasmas generated from these gases are employed. A stable aluminum oxide layer over the aluminum alloy surface can provide chemical stability and physical integrity which is effective in protecting the aluminum alloy surface from undergoing progressive erosion/corrosion. As described in the Bercaw et al. patents, the presence of an aluminum oxide layer over the surface of the specialty magnesium-containing aluminum alloy described therein helps maintain a magnesium halide protective component at or near the surface of the aluminum alloy. The aluminum oxide helps prevent abrasion of the relatively soft magnesium halide component. The combination of the aluminum oxide film and the magnesium halide protective component overlying the specialty aluminum alloy provides an article capable of long term functionality in the corrosive environment. However, one requirement which has not been adequately addressed in the past is the mechanical performance of the article. In attempting to obtain the mechanical properties required for the aluminum alloy body of the article, it is possible to affect the surface of the aluminum alloy in a manner such that a subsequently-formed aluminum oxide (anodized) layer does not form a proper interface with the aluminum alloy, especially at the grain boundary areas. This creates gaps between the aluminum oxide layer and the underlying aluminum surface. This porosity promotes a breakdown in the protective aluminum oxide layer, which leads to particle formation, and may cause a constantly accelerating degradation of the protective aluminum oxide film.

Not only is there significant expense in equipment maintenance and apparatus replacement costs due to degradation of the protective aluminum oxide film, but if a susceptor, for example, develops significant surface defects, these defects can translate through a silicon wafer atop the susceptor, creating device current leakage or even short. The loss of all the devices on a wafer can be at a cost as high as $50,000 to $60,000 or more.

It is clear that there are significant advantages to providing an interface between a protective aluminum oxide and the underlying aluminum alloy with sufficient stable mechanical, chemical, and physical properties to extend the lifetime of the protective film. It is also clear that it would be beneficial to provide a less porous, dense, and more stable aluminum oxide film.

SUMMARY OF THE INVENTION

We have discovered that the formation of particulate inclusions at the surface of an aluminum alloy article, which inclusions interfere with a smooth transition from the alloy surface to an overlying aluminum oxide protective film, can be controlled by a combination of processing parameters which include: maintaining the content of mobile impurities within a specific range; heat-treating the aluminum alloy at a temperature less than about 330° C., while employing temperature ramp rates and dwell times specific to the aluminum alloy composition and the size and shape of the article; and, creating the aluminum oxide protective film by employing a particular electrolytic process. When these factors are taken into consideration, an improved aluminum oxide protective film is obtained, and the protective lifetime of the film is significantly extended compared with the lifetime of previously known protective anodized films.

In particular, the aluminum alloy which is used to form the body of an article of apparatus, may be forged, extruded or rolled. The aluminum alloy should have the following composition by weight %: a magnesium concentration ranging from about 3.5% to about 4.0%, a silicon concentration ranging from 0% to about 0.03%, an iron concentration ranging from 0% to about 0.03%, a copper concentration ranging from about 0.02% to about 0.07%, a manganese concentration ranging from about 0.005% to about 0.015%, a zinc concentration ranging from about 0.08% to about 0.16%, a chromium concentration ranging from about 0.02% to about 0.07%, and a titanium concentration ranging from 0% to about 0.01%, with other single impurities not exceeding about 0.03% each and other total impurities not exceeding about 0.1%.

In addition, the aluminum alloy is required to meet a particular specification with respect to particulates formed from mobile impurities. Of the particulate agglomerations of impurity compounds, at least 95% of all particles must be less than 5 μm in size. Five (5) % of the particles may range from 5 μm to 20 μm in size. Finally, no more than 0.1% of the particles may be larger than 20 μm, with no particles being larger than 40 μm.

The aluminum alloy described above is referred to as LP™ alloy herein. LP™ is a trademark of Applied Materials, Inc. of Santa Clara, Calif.

The LP™ aluminum alloy in sheet or extruded or forged form, or after pre-machining into a desired shape, is typically stress relieved at a temperature of about 330 ° C. or less, prior to creation of an aluminum oxide protective film over the article surface. This stress relief provides a more stable surface for application of the aluminum oxide protective film. A side benefit of the heat treatment process is that it provides additional hardening of the alloy, despite prior art assertions to the contrary. When the LP™ aluminum alloy article is machined from a block of material, it is advantageous to stress relieve the block of material after machining, to relieve stress resulting from the machining operation. We have discovered that it is very important to heat relieve thermal stress in the LP™ aluminum alloy using lower peak temperatures than commonly recommended for aluminum alloys. Employment of a peak stress relief temperature of less than about 330° C. will minimize the undesirable precipitation of impurities at the aluminum grain boundaries and eliminate unwanted aluminum grain growth. This ensures the desired material properties of the alloy with respect to grain structure, non-aluminum metal (mobile impurity) distribution and mechanical properties in the article produced. By controlling the grain size of the aluminum alloy, the distribution of mobile impurities within the alloy, and the residual stress within the article to be anodized, the interface between a protective aluminum oxide film and the underlying aluminum alloy provides a uniform transition from one crystal structure to another, improving the performance and lifetime of the article.

The aluminum oxide protective film is applied using an electrolytic oxidation process which produces an integrated coating of aluminum oxide which is porous to halogens but not to oxygen. Typically, the article to be anodized is immersed as the anode in an acid electrolyte, and a DC current is applied. On the surface, the aluminum alloy is electrochemically converted into a layer of aluminum oxide.

Prior to the anodization process, it is important to chemically clean and polish the aluminum alloy surface. The cleaning is carried out by contacting the surface of the aluminum article with an acidic solution including about 60% to 90% technical grade phosphoric acid, having a specific gravity of about 1.7 and about 1%–3% by weight of nitric acid. The article temperature during cleaning is typically in the range of about 100° C., and the time period the surface of the article is in contact with the cleaning solution ranges from about 30 to about 120 seconds. This cleaning and polishing time period is often referred to as the "bright dip" time. Typically the cleaning process is followed by a deionized water rinse.

Subsequent to cleaning, anodization of the aluminum alloy surface is carried out, to create a protective aluminum oxide film on the alloy surface. The anodization is carried out electrolytically in a water-based solution comprising 10% to 20% by weight sulfuric acid and about 0.5% to 3.0% by weight oxalic acid. The anodizing temperature is set within a range from about 5° C. to about 25° C., and typically within a range from about 7° C. to about 21° C. The article to be "anodized" serves as the anode, while an aluminum sheet of standard 6061 serves as the cathode. We have discovered that it is very important that during the electrolytic oxidation process the current density, in Amps/Square Foot (ASF) in the electrolytic bath, ranges from about 5 ASF to less than 36 ASF. Further, the "barrier layer" thickness (shown as 310 on FIG. 3C) at the base of the aluminum oxide film is controlled by the operating (anodization) voltage, which typically ranges from about 15 V to about 30 V. Common practice has indicated that each 1V increase in anodization voltage increases the barrier layer thickness at the base of the film by about 14 Å.

The particular combination of process variables described above also produces an oxidized aluminum layer which is more densely packed and more uniform than previously known in the art. For example, the size of the internal pores (shown as 314 on FIG. 3C) within the hexagonal cells of the oxidized aluminum film of the present invention range in size from about 300 Å to about 700 Å. This is compared with previously known oxidized aluminum films, where the pore size varied from about 100 Å to about 2000 Å in diameter. As a result, the density of the present oxidized film is generally higher, providing improved abrasion resistance. Depending on the application, the normal range of the anodized film thickness ranges between about 0.7 mils to about 2.5 mils (18 μm to 63 μm).

Although the above anodization process is beneficial for any article formed from the specialized halogen-resistant aluminum alloy article described in the Bercaw et al. patents, it is particularly beneficial when the aluminum alloy is LP™. In addition, when the halogen-resistant aluminum article is heat treated for stress relief and hardening at a temperature of less than about 330° C., the performance lifetime of the anodized semiconductor apparatus is further improved. The best-performing anodized aluminum alloy article is one formed from LP™ alloy which has been heat treated at temperatures below about 330° C., and which has an electrochemically applied aluminum oxide protective film. The quality of the protective coating is further improved when the alloy article surface is cleaned prior to anodization, as previously described.

BRIEF DESCRIPTION OF THE DRAWINGS

A better understanding of the invention is obtained when the following detailed description is considered in conjunction with the following drawings in which.

DETAILED DESCRIPTION OF THE INVENTION

As a preface to the detailed description, it should be noted that, as used in this specification and the appended claims, the singular forms "a", "an", and "the" include plural referents, unless the context clearly dictates otherwise.

The objective of the present invention is to provide a semiconductor processing apparatus which is resistant to corrosive processing conditions. In general, the body of the apparatus is formed from an aluminum alloy. To enable the aluminum alloy to resist corrosion, an aluminum oxide protective film is applied over a surface of the aluminum alloy which is to be exposed to the corrosive processing environment. To obtain the best corrosion resistance and longest acceptable performance lifetime for the apparatus article, the article is fabricated in a particular manner. As described above, for best results, the aluminum alloy used for the body of the article should be formed from a specialized halogen-resistant aluminum alloy of the kind described in the Bercaw et al. patents. It is particularly beneficial when the aluminum alloy is the LP™ alloy. In addition, it is advantageous to heat treat the aluminum alloy for stress relief and hardening at a temperature of less than about 330° C. prior to creation of the protective aluminum oxide film over a surface of the apparatus article. The aluminum oxide film is then applied using the electrolytic anodization process described below in detail. A semiconductor processing apparatus article formed from LP™ alloy, where the alloy was heat treated at a temperature below about 330° C. to relieve stress while reducing the possibility of an increase in the size of particulates formed at aluminum grain boundaries during the heat treatment, and where an electrochemically applied aluminum oxide protective film applied using the method described herein performs particularly well.

For particular applications, the high purity alloy specification related to particle size and particle size distribution may be relaxed from the requirement that no more than 0.1% of the particles may be larger than 20 μm, with no particles being larger than 40 μm to a requirement that no more than 0.2% of the particles may be larger than 20 μm, with no particles being larger than 50 μm.

Figure 1:
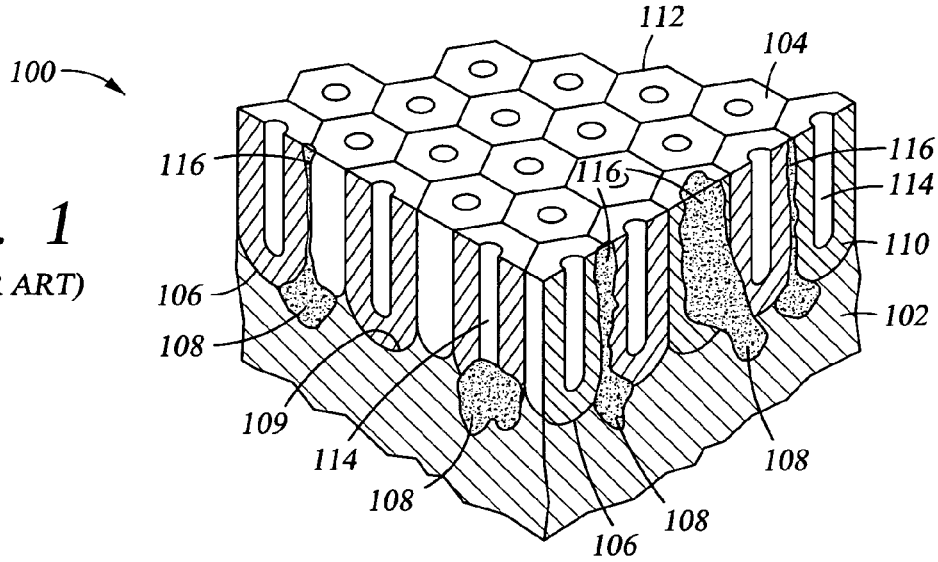
Fig. 1 (PRIOR ART)
FIG. 1 illustrates a schematic three-dimensional structure 100 of an aluminum alloy 102 having an aluminum oxide (anodized) film 104 on its upper surface 106, where there are defects (particulate inclusions 108) at the interface between the alloy surface 106 and the bottom of the anodized film surface 109, which cause the formation of conduits 116 which leave the aluminum alloy surface 106 open to attack by reactive species.

With reference to FIG. 1, a structure 100 is illustrated, the structure comprising an aluminum alloy 102 and an anodized aluminum layer 104 created by an electrolytic oxidation process. The anodized aluminum layer (film) 104 consists of a fairly dense $Al_2O_3$ barrier layer having a thickness ranging between about 100 Å and about 2000 Å. The anodized film 104 grows in the form of hexagonal cells 112 with internal pores 114 which are typically about 100 Å to about 2000 Å in diameter, depending on the conditions of anodization. Thus, the principal protection of base aluminum alloy 102 from the harsh halide-enriched plasma environment in a CVD reactor chamber, for example, is dense barrier layer 110 at the base of anodized film 104, and a magnesium halide film (not shown) formed on the upper surface 106 of aluminum alloy 102 due to the presence of magnesium in aluminum alloy 102. The hexagonal cells 112 contribute to increased wear resistance of the anodized aluminum layer 102. However, halogen atoms, ions, and activated species are relatively small in size, with fluorine ions being less than about 5 Å in diameter, for example. It has been determined that there is a high probability of penetration of the anodized aluminum film by about 5%–10% of the active fluorine ions present in a gaseous fluorine-containing plasma. The magnesium halide film (not shown) is typically only about 25 Å thick, so it is desirable to have the anodized film 104 be densely formed with minimal pore 114 diameter and to have the lower surface 109 of anodized film 104 interface tightly with the upper surface 106 of aluminum alloy 102.

Mobile impurities within the aluminum alloy form agglomerations within the alloy which tend to migrate to the upper surface 106 of alloy 102. The agglomerated impurities, which are typically comprised of magnesium, silicon, iron, copper, manganese, zinc, chromium, titanium, and compounds thereof, may appear as particulates 108 at aluminum grain boundaries. If the particulates 108 are sufficiently large, they prevent a good interface from forming between the newly growing aluminum oxide film 104 at its base 110 and the upper surface 106 of aluminum alloy 102. The presence of particulates 108 may cause the formation of gaps, voids, or microcracks, which create conduits 116 through the thickness of aluminum oxide film 104. The gaps or voids may form beneath a pore 114 which also creates conduits through the thickness of aluminum oxide film 104. These gaps, voids and microcracks open a pathway through the aluminum oxide film 104 which exposes the upper surface 106 of aluminum alloy 102 to attack by reactive species.

Figure 2A:
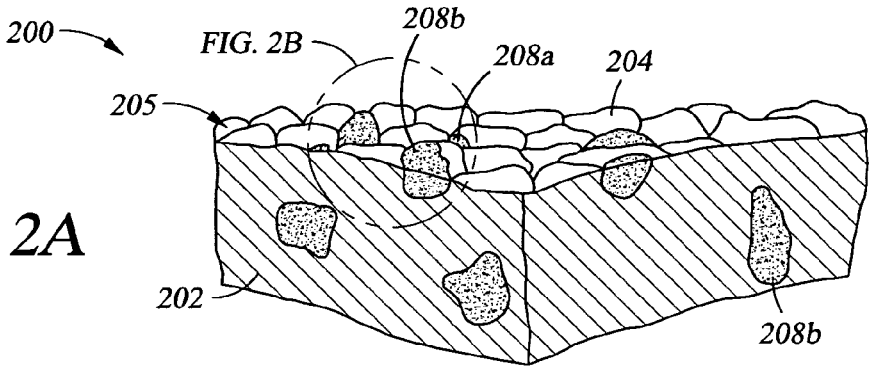
FIG. 2A shows a schematic three-dimensional structure 200 of an aluminum alloy 202 having an upper surface 205 comprised of aluminum crystalline grains 204.
Figure 2B:
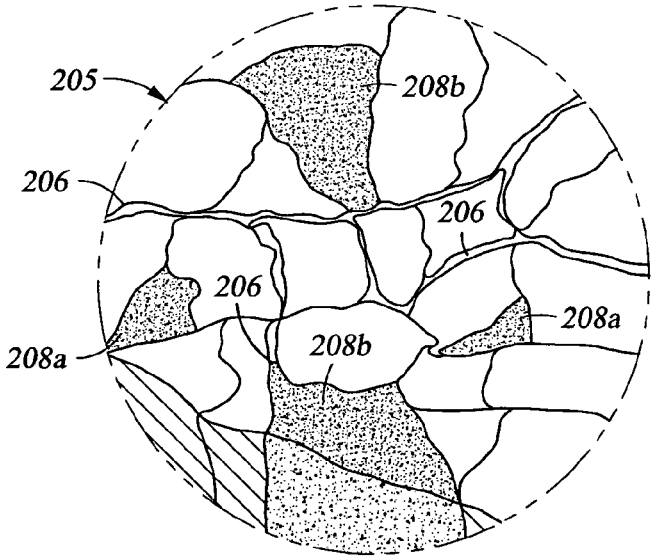
FIG. 2B shows the upper surface 205 of the structure 200 in more detail, where aluminum grains 204 have boundaries 206 with particulate inclusions 208 present within boundaries 206.

FIG. 2A shows a schematic three-dimensional view of a structure 200 which includes an aluminum alloy layer 202, illustrating grains 204 at the upper surface 205 of aluminum alloy layer 202. FIG. 2B shows an enlargement of the upper surface 205 of aluminum alloy layer 202, illustrating aluminum grains 204, grain boundaries 206, and mobile impurity agglomerates in the form of particulates 208*a* and 208*b*. The 208*a* particulates are small in size, typically less than about 5 μm. The 208*b* particulates are much larger in size, typically larger than about 20 μm.

Figure 3A:
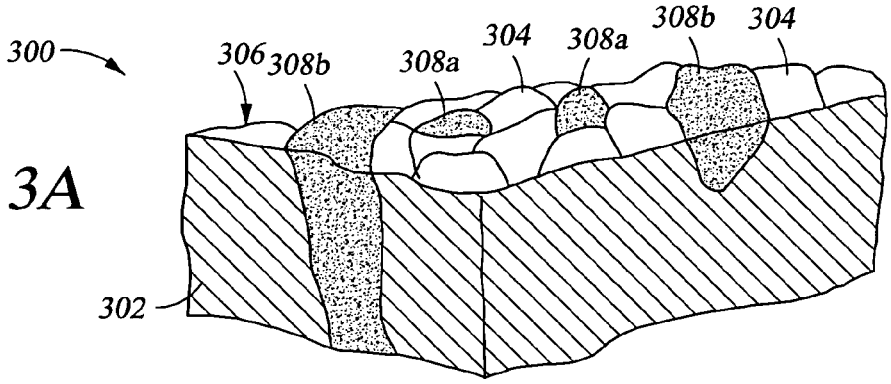
FIG. 3A shows a schematic three-dimensional view of a structure 300 which is an aluminum alloy 302, where the upper surface 306 includes aluminum crystalline grains 304 and particulate inclusions which are small in size 308*a* and large in size 308*b*.

FIG. 3A shows a schematic three-dimensional view of a structure 300 which includes an aluminum alloy layer 302, illustrating grains 304 at the upper surface 305 of aluminum alloy layer 302. Mobile impurity agglomerates are present in the form of large particulates 308*b* and small particulates 308*a*.

Figure 3B:
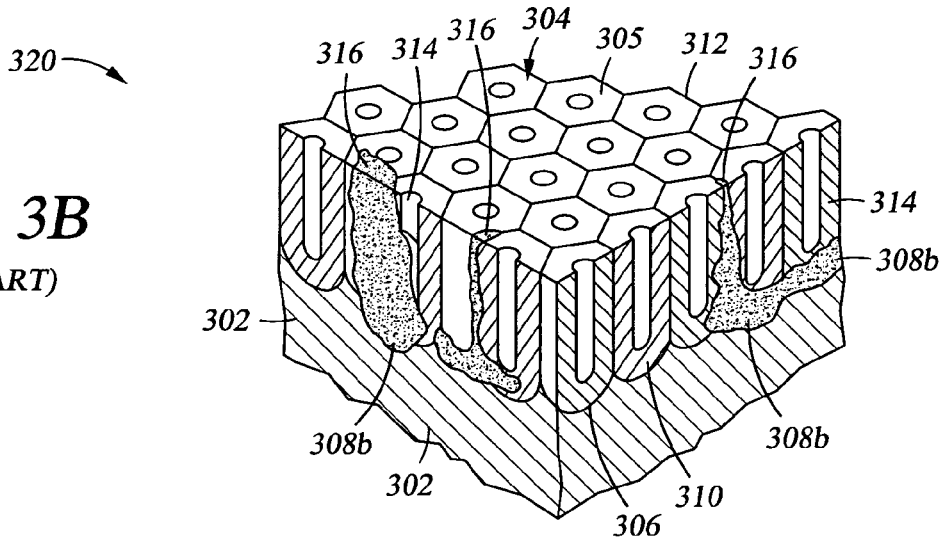
Fig. 3B (PRIOR ART)
FIG. 3B shows a schematic three-dimensional view of a structure 320 after formation of an anodized layer (aluminum oxide film) 304 over the upper surface 306 of aluminum alloy 302. Large particulates 308*b* have caused the formation of conduits 316 from the upper surface 305 of anodized layer 304, through to the upper surface 306 of aluminum alloy 302.

FIG. 3B shows a structure 320 which illustrates the effect of the presence of the large particulates 308*b* on an aluminum oxide film 304 formed over large particulates 308*b*. Conduits 316 are formed from upper surface 305 through to underlying aluminum alloy layer 302, due in part to structural differences between the mobile impurity compounds making up the large particulates and the aluminum grain structure. For example, the aluminum grain structure is face-centered-cubic (fcc), which has a space group Fm3m ($O_h^5$), and Lattice Parameter (A) where a=4.050. This compares with mobile impurity compounds such as, for example: $Mg_2Al_3$ having an fcc structure type, a space group Fd3m ($O_h^7$), and Lattice Parameter (A), where a=28.160; $FeAl_3$ having a mono structure type, a space group C2/m ($C_{2h}^3$), and Lattice Parameter (A), where a=15.490, b=8.080, c=12.480, and β=107° 43'; $FeSiAl_5$ having a mono structure type, a space group C2/m($C_{2h}^3$), and Lattice Parameter (A), where a=6.120, b=6.120, c=41.480, and β=91°; $CrAl_7$, having an ortho structure type and a Lattice Parameter (A), where a=24.800, b=24.700, and c=30.200; $MnAl_4$ having a space group Pnnn and a Lattice Parameter (a), where a=6.795, b=9.343, and c=13.839; and $Cr_2Mg_3Al$ having an fcc structure type, a space group Fd3m ($O_h^7$), and Lattice Parameter (A), where a=14.550. This illustrates the importance of minimizing the quantity of mobile impurity atoms which are available to react with aluminum to form compounds which agglomerate to form large particulates 308*b* at the grain boundaries of aluminum grains 304. A comparison of the differences between the structural characteristics of aluminum and such mobile impurity compounds also indicates why the presence of such mobile impurity compounds creates stress within the aluminum alloy and affects mechanical properties of the alloy as well.

Figure 3C:
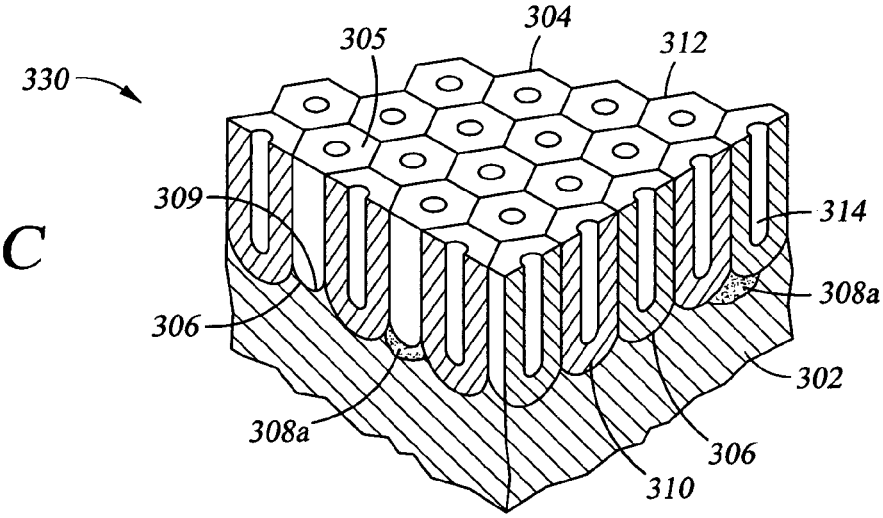
FIG. 3C shows a schematic three-dimensional view of a structure 330 after formation of an anodized layer 304 over the upper surface 306 of aluminum alloy 302. However, only small particulates 308*a* are present at the upper surface 306 of aluminum alloy 302, and no conduits are present from the upper surface 305 of anodized layer 304 to the upper surface 306 of aluminum alloy 302.

FIG. 3C shows a structure 330 which illustrates that the presence of small particulates 308*a* does not disrupt the interface between the upper surface 306 of aluminum alloy 302 and the lower surface 309 of aluminum oxide layer 304 to the extent that porosity through aluminum oxide layer 304 is increased. The upper surface of aluminum oxide layer 305 is essentially undisturbed, and the lower dense portion 310 of aluminum oxide layer 310 is generally undisturbed.

We were able to control two major factors which affect the size and distribution of the particulates 308. The two factors were the amount of mobile impurities in the LP™ aluminum alloy as originally formed, and the heat treatment process used for reducing stress and hardening the LP™ aluminum alloy prior to creation of the aluminum oxide layer 304.

With respect to the LP™ aluminum alloy, the composition of the aluminum alloy is high purity, with mobile impurities limited so that the following weight % of such mobile impurities are present: magnesium at a magnesium concentration ranging from about 3.5% to about 4.0%, a silicon concentration ranging from 0% to about 0.03%, an iron concentration ranging from 0% to about 0.03%, a copper concentration ranging from about 0.02% to about 0.07%, a manganese concentration ranging from about 0.005% to about 0.015%, a zinc concentration ranging from about 0.08% to about 0.16%, a chromium concentration ranging from about 0.02% to about 0.07%, and a titanium concentration ranging from 0% to about 0.010%, with other single impurities not exceeding about 0.03% each and other total impurities not exceeding about 0.1%. The alloy composition measurement was made by Sparking method for GDMS or by Molten method for GDMS.

In addition to the compositional limitations, applicants required the following additional specifications with respect to the LP™ aluminum alloy. Of the particulate agglomerations of impurity compounds, at least 95% of all particles must be less than 5 μm in size. Five (5) % of the particles may be larger than 5 μm but less than 20 μm in maximum dimension. Finally, no more than 0.1% of the particles may be larger than 20 μm, with no particles being larger than 40 μm. The analysis technique used to determine particle size and size distribution was based on back scattered image analysis under the scanning electron microscope (SEM). The equipment used to conduct measurements was a KLA TENCOR® Surf Scan machine. The magnification was at 500× in order to assess the constituent particles. The area of each image was about 150 μm×200 μm. The digital resolution was at least 0.2 μm/pixel. At least 40 images were taken at random from a sample area of 0.75 inch diameter in order to obtain good assessment of various areas on the metal microstructure, to ensure meaningful statistical analysis. The back scattered images were digitally stored to provide for statistical analysis. The images were transferred to an image analyzer and the distribution of the particles with a mean atomic number higher than that of Al (white in the images) were detected and measured. The digital resolution allowed for measurement of particles as small as 0.2 μm. The image analyzer used was IBAS by Zeiss. Particle agglomerates were seen as precipitated particles. The parameters to determine the particle's size distribution were: the diameter of the area equal circle $\phi=2\times\text{square root of }(A/\pi)$, where A is the area of a particle. The class limits were as follows: 0.2; 1; 2; 3; 4; 5; 20; 40. The number of particles in each class was determined and then normalized to 100% for the total number of particles measured.

Cabot Corporation has offered a high purity aluminum alloy designated C-276 for general sale for more than 20 years. This high purity aluminum alloy is similar in chemical composition to the high purity aluminum alloy we have developed for use in the present invention. However, the C-276 alloy compositional ranges exceed the maximum concentration specified for particular mobile impurities in the present invention, with respect to copper, manganese, chromium and zinc. The difference in copper concentration is important, as copper migration within semiconductor processing equipment is a problem. In addition, published data for the C276 alloy indicates that approximately 3% to 4% of the particles present in extruded C-276 are 20 μm or larger in size. No maximum particle size is specified. This is likely to present a surface prior to anodization which will cause problems in terms of creating voids, gaps or cracks in an anodized film formed over such a surface. On machining of this surface prior to anodization, the 3% to 4% of large particles will present localized microcracking and loosely bonded particulates. Since a typical aluminum oxide protective film is about 25 μm thick, there is a possibility that particulates on the C-276 aluminum alloy surface may pass all the way through the anodized film. For purposes of comparison, the LP™ extruded alloy contains less than 0.1% of particles having a size of 20 μm or larger.

We also controlled the heat-treatment temperature of the LP™ alloy during stress relief and hardening, so that particulate inclusions would not be increased in size during the heat-treatment process. The heat treatment temperature during stress relief and hardening was maintained at 330° C. or lower. To determine the effect of heat treatment on the size and number of impurity compound particulate inclusions, the test described above may be carried out before and after the heat treatment process. The heat treatment process may be adjusted if necessary. As previously mentioned, typically the heat treatment for stress relief and hardening is performed prior to the creation of the aluminum oxide protective film over a surface of the aluminum alloy.

After preparation of the LP™ high purity aluminum alloy article (typically including heat treatment for stress relief and hardening), the surface of the article which was to be anodized was cleaned (and chemically polished). The cleaning was carried out by immersing the aluminum article in an acidic solution including about 60% to 90% by weight of technical grade phosphoric acid, having a specific gravity of about 1.7, and about 1%–3% by weight of nitric acid. The article temperature during cleaning was in the range of about 100° C., and the article was in the cleaning solution for a time period ranging from about 30 to about 120 seconds. This cleaning and polishing time period, which is typically referred to as the "bright dip" time, is particularly important. If the cleaning time is too short, contaminants may remain on the article surface. If the cleaning time is too long, craze lines appear in the subsequently formed aluminum oxide film and the film degrades more rapidly during the lifetime of the article. In addition customers for the corrosion resistant semiconductor processing apparatus who observe the microcracks worry about what is happening beneath the microcracks. Typically, the cleaning process was followed by a deionized water rinse.

The aluminum oxide protective film was generated using an electrolytic oxidation process which produced an integrated structure including a protective film of aluminum oxide which exhibited improved corrosion resistance. The article to be anodized was immersed as the anode in an electrolyte bath comprised of a water-based solution including 10% to 20% by weight sulfuric acid and about 0.5% to 3.0% by weight of oxalic acid. The anodizing temperature was set within a range from about 7° C. to about 21° C. The article served as the anode, while a sheet of 6061 aluminum served as the cathode. A DC current was applied to the electrolytic circuit, taking care that the current density, in Amps/Square Foot (ASF) in the electrolytic bath, ranged from 5 ASF to less than 36 ASF. The current density is particularly important, since a current density of less than 5 ASF will not produce a sufficiently dense aluminum oxide protective film and a current density greater than 36 ASF produces a film which degrades during its lifetime, including localized burning, especially at sharp edged areas.

The particular combination of process variables, including the use of LP™ alloy, heat treating at less than 330° C., and the creation of a protective aluminum oxide film using the anodization process described above, generated a structure which included a more dense and uniform aluminum oxide film than that previously obtained. Data for anodized films in general indicated that the internal pores within the hexagonal aluminum oxide cells ranged in size from about 100 Å to about 2,000 Å. Data for the anodized film produced by our method indicates the internal pores range from about 300 Å to about 750 Å, falling within the bottom 30% of the general range. As a result, the anodized film density is on the high side, improving abrasion resistance and corrosion resistance for the film.

Test coupons of the LP™ alloy with protective aluminum oxide film were prepared and tested for corrosion resistance of the structure. Film corrosion resistance was tested using a "hydrogen bubble test". In particular, the purpose of the test was to infer the integrity of an anodized film by measuring the time before the film is breached by hydrochloric acid applied to the film surface. The test could be made using hydrofluoric acid, but the state of California will not permit the use of this substance as a test reagent, so it was not used herein. The hydrochloric acid used in the test was a 5% by weight concentration. A rigid, transparent polymer or glass tubing section having a diameter of about 0.5 to about 1.5 inch, and a length of at least one inch, with ends cut flush, was sealed to the upper surface of the anodized film on the test coupon. The seal must be water proof and acid proof and was created in this instance using an o-ring and clamps. The test coupon, hydrochloric acid solution and ambient temperature was between 20° C. and 30° C. during testing. The test coupon was mounted so that the test surface was horizontal and facing upward. No portion of the anodized surface within the sealed tubing was within 0.7 inch of the edge of the test coupon. The hydrochloric acid solution was introduced into the tubing to a depth of at least 0.6 inches, and a timer was started or the time was noted. After a minimum specified time had elapsed, the test coupon was observed for the presence of a stream of bubbles rising from the anodized film surface. Hydrochloric acid reacts with aluminum oxide with little gas generation; however, hydrochloric acid produces a noticeable amount of hydrogen gas when reacting with the aluminum alloy. Failure of the aluminum oxide film to protect the underlying aluminum alloy is clearly indicated by the bubbles rising from the film surface. Testing was continued until bubble formation was observed. After completion of the test, the residual hydrochloric acid was removed, and the test coupon with sealed tubing applied was flushed with ionized water at least twice. The tubing was then removed and the surface of the anodized protective film was wiped with deionized water and then with isopropyl alcohol. The film surface could then be further inspected if desired.

Test data for a 6061 aluminum alloy protected by a standard anodized coating about 25 μm thick shows hydrogen bubble test failure after about 2 hours of exposure on the average. Test data for the LP™ aluminum alloy protected by an anodized film prepared by the method of invention described herein shows bubble test failure only after at least 20 hours of exposure.

The above described exemplary embodiments are not intended to limit the scope of the present invention, as one skilled in the art can, in view of the present disclosure, expand such embodiments to correspond with the subject matter of the invention claimed below.

We claim:

1. A method of creating an aluminum oxide protective film on a surface of a high purity aluminum alloy, comprising:

providing an aluminum alloy, wherein said alloy includes mobile impurities present at the following concentrations, magnesium at a concentration ranging from about 3.5 weight % to 4.0 weight %, silicon at a concentration ranging from 0 weight % to 0.03 weight %, iron at a concentration ranging from about 0 weight % to 0.03 weight %, copper at a concentration ranging from about 0.02 weight % to 0.07 weight %, manganese at a concentration ranging from about 0.005 weight % to 0.015 weight %, zinc at a concentration ranging from about 0.08 weight % to 0.16 weight %, chromium at a concentration ranging from about 0.02 weight % to 0.07 weight %, titanium at a concentration ranging from 0 weight % to 0.01 weight %, with individual other impurities limited to 0 weight % to 0.03 weight % each, wherein mobile impurity particulates present in said high purity aluminum alloy are limited so that at least 95% of all particles have a particle size of less than 5 μm, no more than 5% of said particles have a particle size ranging between 20 μm and 5 μm, and no more than 0.2% of said particles have a particle size ranging between 50 μm and 20 μm and exposing said surface of said aluminum alloy to an electrolytic oxidation process during which said surface is immersed as an anode in an acid electrolyte, with a cathode comprised of an aluminum alloy, and wherein a DC current is applied, wherein said acid electrolyte is a water-based solution comprising 10% to 20% by weight sulfuric acid and about 0.5% to 3.0% by weight oxalic acid, wherein said protective film is created at a temperature ranging from about 5° C. to about 25° C., and wherein an applied current density of said DC current ranges from 5 A/ft$^2$ to 36 A/ft$^2$.

2. A method of creating an aluminum oxide protective film on a surface of a high purity aluminum alloy, comprising:

providing an aluminum alloy, wherein said alloy includes mobile impurities present at the following concentrations, magnesium at a concentration ranging from about 3.5 weight % to 4.0 weight %, silicon at a concentration ranging from 0 weight % to 0.03 weight %, iron at a concentration ranging from about 0 weight % to 0.03 weight %, copper at a concentration ranging from about 0.02 weight % to 0.07 weight %, manganese at a concentration ranging from about 0.005 weight % to 0.015 weight %, zinc at a concentration ranging from about 0.08 weight % to 0.16 weight %, chromium at a concentration ranging from about 0.02 weight % to 0.07 weight %, titanium at a concentration ranging from 0 weight % to 0.01 weight %, with individual other impurities limited to 0 weight % to 0.03 weight % each, wherein mobile impurity particulates present in said high purity aluminum alloy are limited so that at least 95% of all particles have a particle size of less than 5 μm, no more than 5% of said particles have a particle size ranging between 20 μm and 5 μm, and no more than 0.2% of said particles have a particle size ranging between 50 μm and 20 μm;

contacting said surface with an acidic solution which includes about 60% to 90% by weight of technical grade phosphoric acid, having a specific gravity of about 1.7, and including about 1% to about 3% by weight of nitric acid, wherein said cleaning is carried out with said aluminum alloy surface at a temperature in the range of about 100° C., for a time period ranging from about 30 seconds to about 120 seconds; and exposing said surface of said aluminum alloy to an electrolytic oxidation process during which said surface is immersed as an anode in an acid electrolyte, with a cathode comprised of an aluminum alloy, and wherein a DC current is applied, wherein said acid electrolyte is a water-based solution comprising 10% to 20% by weight sulfuric acid and about 0.5% to 3.0% by weight oxalic acid, wherein said protective film is created at a temperature ranging from about 5° C. to about 25° C., and wherein an applied current density of said DC current ranges from 5 $A/ft^2$ to 36 $A/ft^2$.

3. A method of creating an aluminum oxide protective film on a surface of a high purity aluminum alloy, comprising:

providing an aluminum alloy, wherein said alloy includes mobile impurities present at the following concentrations, magnesium at a concentration ranging from about 3.5 weight % to 4.0 weight %, silicon at a concentration ranging from 0 weight % to 0.03 weight %, iron at a concentration ranging from about 0 weight % to 0.03 weight %, copper at a concentration ranging from about 0.02 weight % to 0.07 weight %, manganese at a concentration ranging from about 0.005 weight % to 0.015 weight %, zinc at a concentration ranging from about 0.08 weight % to 0.16 weight %, chromium at a concentration ranging from about 0.02 weight % to 0.07 weight %, titanium at a concentration ranging from 0 weight % to 0.01 weight %, with individual other impurities limited to 0 weight % to 0.03 weight % each, wherein mobile impurity particulates present in said high purity aluminum alloy are limited so that at least 95% of all particles have a particle size of less than 5 μm, no more than 5% of said particles have a particle size ranging between 20 μm and 5 μm, and no more than 0.2% of said particles have a particle size ranging between 50 μm and 20 μm;

contacting said surface with an acidic solution which includes about 60% to 90% by weight of technical grade phosphoric acid, having a specific gravity of about 1.7, and including about 1% to 3% by weight of nitric acid, wherein said cleaning is carried out with said aluminum alloy surface at a temperature in the range of about 100° C., for a time period ranging from about 30 seconds to about 120 seconds;

rinsing said surface with a deionized water rinse, and;

exposing said surface of said aluminum alloy to an electrolytic oxidation process during which said surface is immersed as an anode in an acid electrolyte, with a cathode comprised of an aluminum alloy, and wherein a DC current is applied, wherein said acid electrolyte is a water-based solution comprising 10% to 20% by weight sulfuric acid and about 0.5% to 3.0% by weight oxalic acid, wherein said protective film is created at a temperature ranging from about 5° C. to about 25° C., and wherein an applied current density of said DC current ranges from 5 $A/ft^2$ to 36 $A/ft^2$.

4. A method in accordance with claim 1 or claim 2, or claim 3, wherein, prior to creating said aluminum oxide protective film on said high purity aluminum alloy surface, said aluminum alloy is heat treated to relieve stress and increase hardness, wherein said heat treatment is carried out at a temperature of 330° C. or at a lower temperature.

* * * * *